US008671999B2

(12) United States Patent
Pashazadeh

(10) Patent No.: US 8,671,999 B2
(45) Date of Patent: Mar. 18, 2014

(54) FOAM RETAINER

(76) Inventor: M Pasha Pashazadeh, New York, NY (US)

( * ) Notice: Subject to any disclaimer, the term of this patent is extended or adjusted under 35 U.S.C. 154(b) by 0 days.

(21) Appl. No.: 13/200,561

(22) Filed: Sep. 24, 2011

(65) Prior Publication Data

US 2013/0061977 A1 Mar. 14, 2013

Related U.S. Application Data

(63) Continuation of application No. 12/459,462, filed on Jul. 1, 2009, now Pat. No. 8,267,267.

(60) Provisional application No. 61/133,665, filed on Jul. 1, 2008.

(51) Int. Cl.
*B65B 39/00* (2006.01)

(52) U.S. Cl.
USPC ..... 141/337; 220/731; 137/170.1

(58) Field of Classification Search
USPC ..... 141/297, 331–345; 137/170.1–170.3; 220/4.01, 4.03, 729, 731
See application file for complete search history.

(56) References Cited

U.S. PATENT DOCUMENTS

| | | | | |
|---|---|---|---|---|
| 2,031,892 | A * | 2/1936 | Johnson | 220/23.83 |
| 2,065,390 | A | 12/1936 | Mulch | |
| 2,675,822 | A | 4/1954 | Redlin | |
| 4,094,445 | A | 6/1978 | Bevan | |
| 4,494,681 | A | 1/1985 | Ueda et al. | |
| 5,590,698 | A | 1/1997 | Whitley et al. | |
| 6,082,389 | A | 7/2000 | Latham et al. | |
| 2010/0230006 | A1 * | 9/2010 | Morgan | 141/337 |

* cited by examiner

*Primary Examiner* — Jason K Niesz
(74) *Attorney, Agent, or Firm* — Robert Z. Evora, Esq.

(57) ABSTRACT

A method for removing foam with a foam retainer constructed with a hollow tubular body including a receiving end and a discharge end. A passage is formed within the hollow tubular body through which a liquid is adapted to flow. The discharge end of the hollow tubular body is adapted to snugly fit onto an open end of a container into which the liquid flows. As the container is filled with the liquid, the foam generated during the dispensing of the fluid rises back into the discharge end of the hollow tubular body. In the hollow tubular body, the foam is received and captivated therein such that when the hollow tubular body is removed, the foam may also be removed from the container.

15 Claims, 11 Drawing Sheets

FOAM RETAINER

CROSS REFERENCE TO RELATED APPLICATION

This application is also a Continuation Application which claims the benefit of the filing date of U.S. Non-Provisional Application Ser. No. 12/459,462, entitled "Foam Retainer" filed Jul. 1, 2009, now U.S. Pat. No. 8,267,267 the entirety of which is incorporated herein by reference. This application also claims the benefit of the filing date of U.S. Provisional Application Ser. No. 61/133,665, entitled "FOAM RETAINER" filed Jul. 1, 2008, the entirety of which is also incorporated herein.

BACKGROUND OF THE INVENTION

1. Field of the Invention

This invention relates to a beverage foam recovery implement, and in particular to a method for removing foam with a foam retainer adapted to assist in capturing and containing carbonated foam generated when a carbonated beverage is poured in a drinking container, which would otherwise flow over the top of a drinking container.

2. Description of the Related Art

Conventionally, when a carbonated beverage is poured from a pressurized container freshly opened, such as a beer, a soda, champagne or the like, excess foam spills over the rim of the drinking container as it is poured. Consequently, much of the beverage is wasted and the container becomes doused with the over-spillage. Traditionally, in order to top off the drinking container with a full glass of the beverage, and with little foam remaining on the surface of the beverage, a preparer must meticulously wait until the foam has dissolved and/or settled down and then add more of the frothy beverage into the drinking container, only again to tediously have to wait for the newly generated foam to dissolve until he can again pour more of the beverage into the drinking container.

The excessive foam makes handling of the beverage and drinking messy and awkward. This process is cumbersome and time consuming to a thirsty waiting customer. Likewise, for a beverage serving establishment, this process is inefficient.

Other than by clumsily removing the foam by skimming the foam off by hand, it is clear that this problem has not been solved and there is still a longstanding need for a retainer that can quickly and efficiently remove foam from a beverage being served. In accordance with this invention, exemplary foam retainers and various configurations are described and shown below which solves this problem.

SUMMARY OF THE INVENTION

The present invention addresses the shortcomings identified in providing a foam reducing retainer.

An object of this invention is to provide a foam retainer having a hollow tubular body. The hollow tubular body includes a receiving end and a discharge end. A passage is formed within the hollow tubular body through which a liquid is adapted to flow. The discharge end of the hollow tubular body is adapted to snugly fit onto an open end of a container into which the liquid flows. As the container is filled with the liquid, the foam generated during the dispensing of the fluid rises back into the discharge end of the hollow tubular body. In the hollow tubular body, the foam is received and captivated therein such that when the hollow tubular body is removed, the foam may also be removed from the container.

Another aspect of this invention is to provide a method of removing foam from a container. The method includes positioning and sealing a discharge end of a hollow tubular body over an open end of the container. Dispensing a liquid into a receiving end of the hollow tubular body. Then, allowing a predetermined foam head to build up in the container and back up into the hollow tubular body. Captivating the predetermined foam head within the hollow tubular body, and then removing the predetermined foam head from the container by removing the hollow tubular body from the container when the predetermined foam head reaches a certain level in the hollow tubular body.

These and other objects, features, and/or advantages may accrue from various aspects of embodiments of the present invention, as described in more detail below.

BRIEF DESCRIPTION OF THE DRAWINGS

Various exemplary embodiments of this invention will be described in detail, wherein like reference numerals refer to identical or similar components or steps, with reference to the following figures, wherein.

DETAILED DESCRIPTION OF EXEMPLARY EMBODIMENTS

Particular embodiments of the present invention will now be described in greater detail with reference to the figures.

Figure 1:
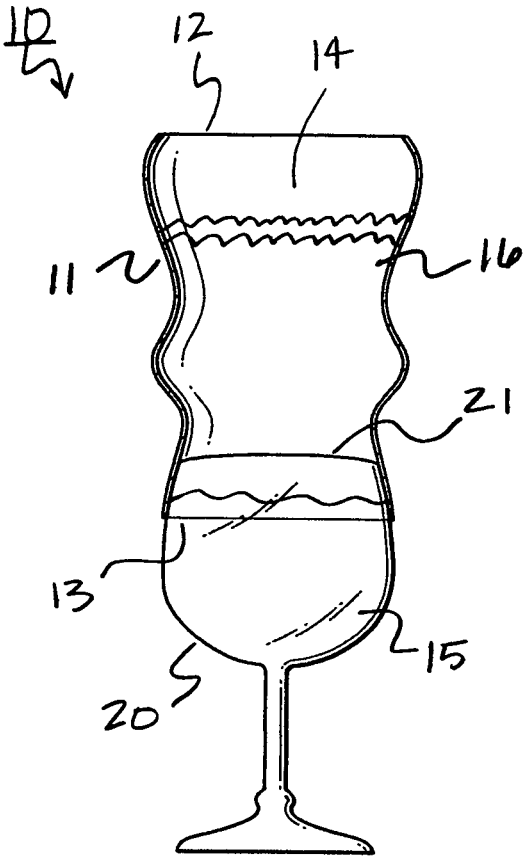
FIGS. 1-3 illustrate various views of exemplary foam retainers placed over a container in accordance with this invention.

FIG. 1 illustrates an exemplary foam retainer 10. The foam retainer 10 includes a hollow tubular body 11 having a receiving end 12 and a discharge end 13. A passage 14 is formed within the hollow tubular body 11 into which a liquid 15 is allowed to flow. As shown, the discharge end 13 is adapted to snugly fit onto an open end 21 of a container 20. As the container 20 is filled with the liquid 15, foam 16 generated during the dispensing of the fluid 15 rises back into discharge end 13 of the hollow tubular body 11 and is received and captivated within the hollow tubular body 11 so that when the hollow tubular body 11 is removed from the container 20, the foam 16 may also be easily removed from the container 20.

Figure 8:
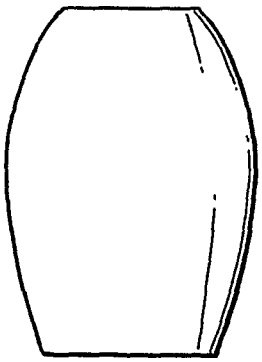
Figure 9:
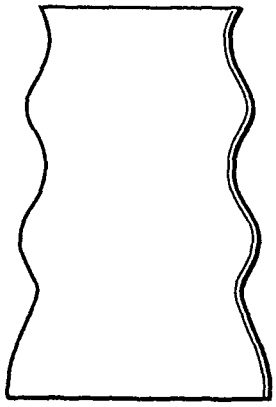
Figure 10:
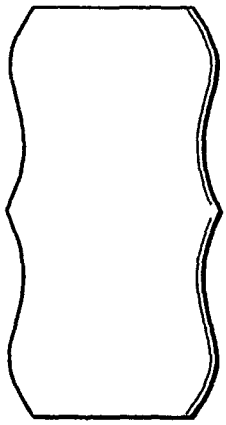
Figure 11:
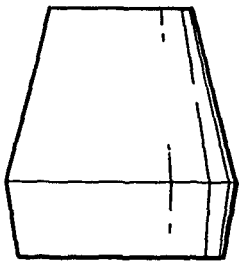
Figure 12:
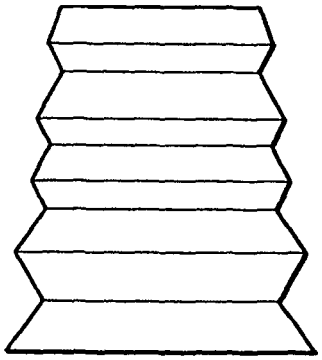
Figure 13:
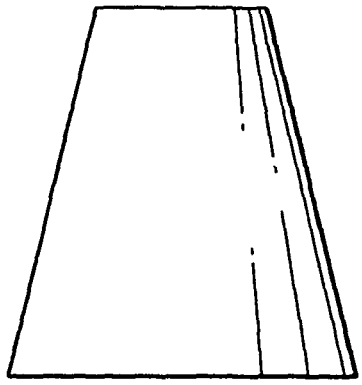
Figure 14:
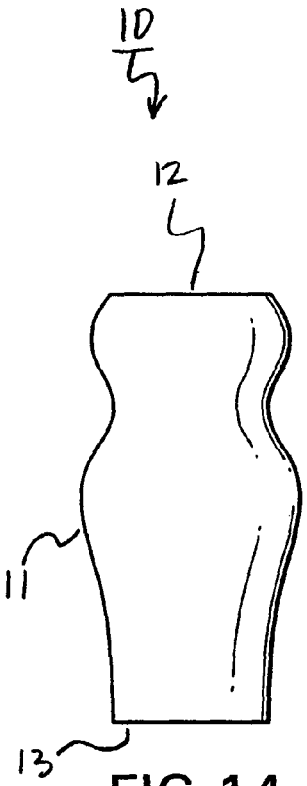
Figure 15:
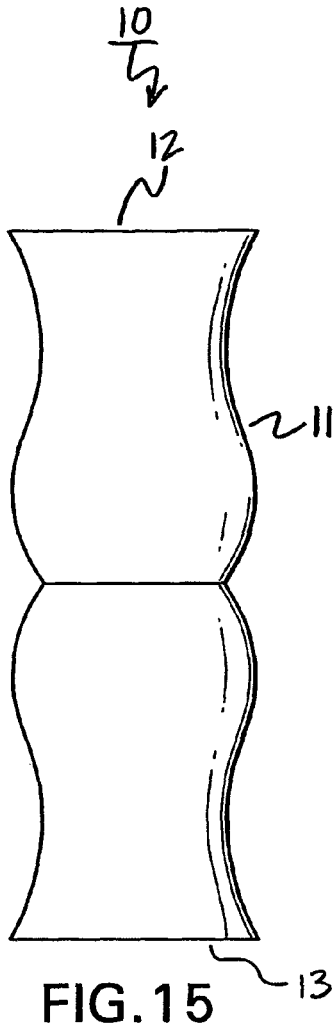
Figure 16:
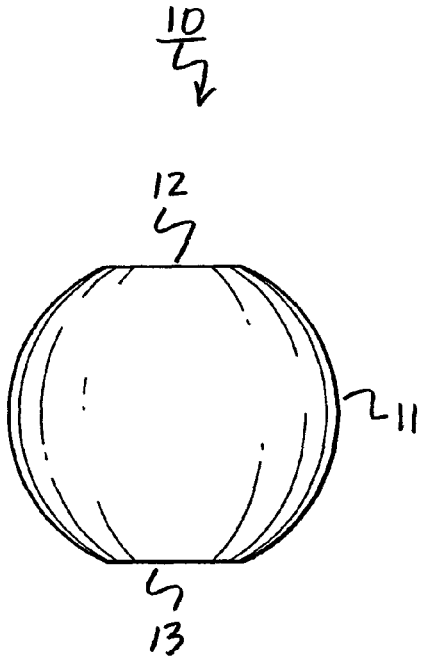
Figures 17, 18, 19:
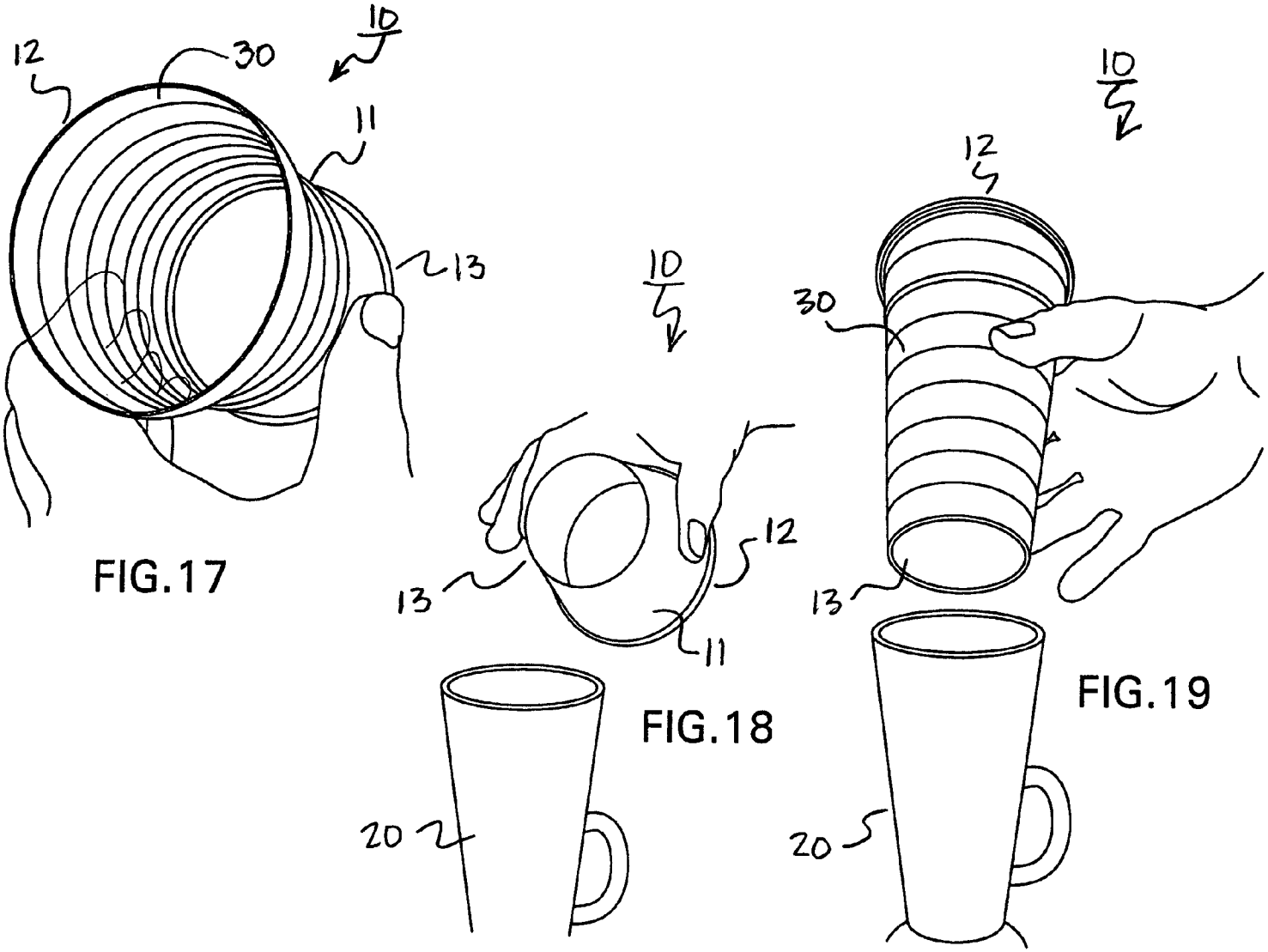
Figure 20:
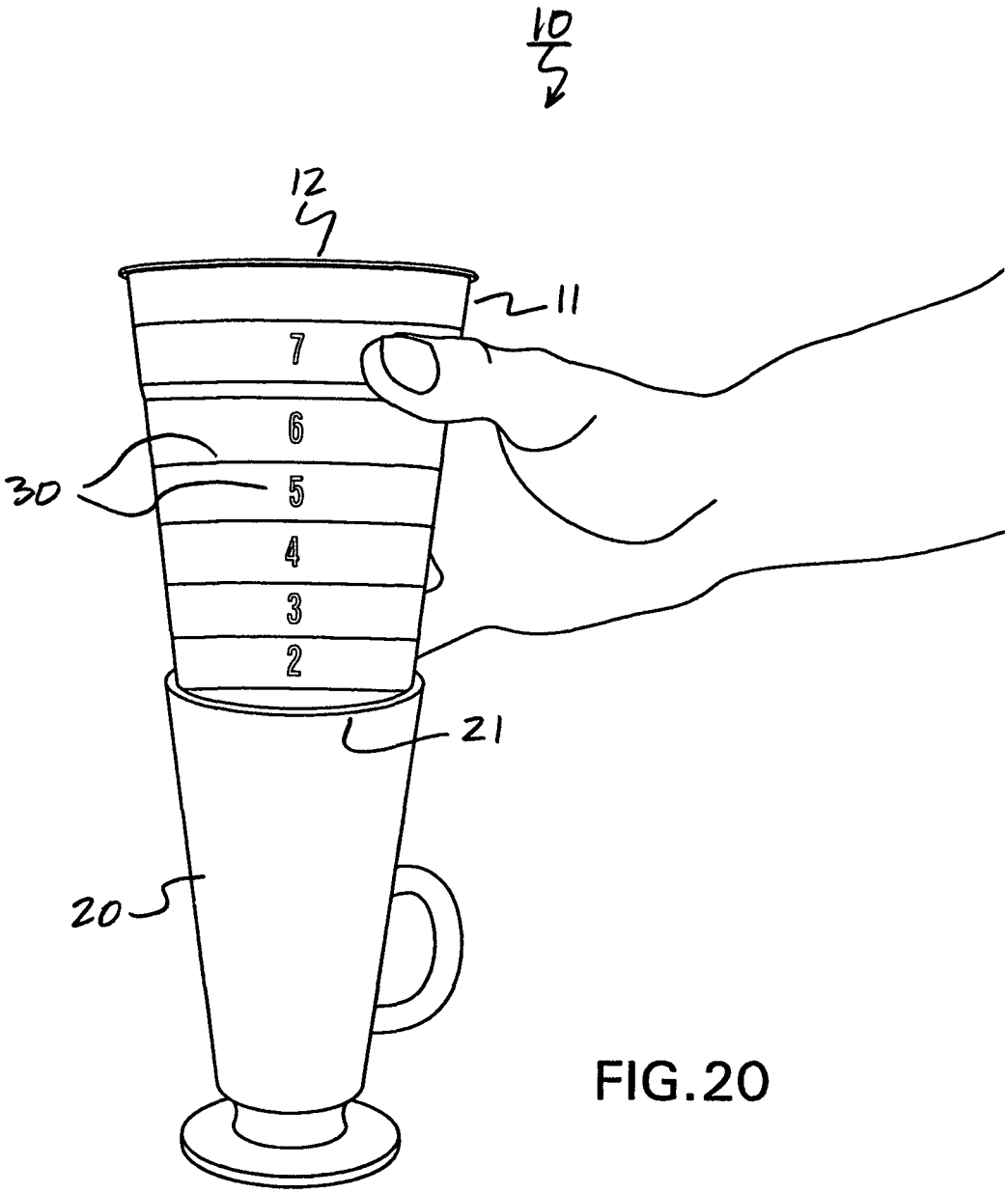

It is to be understood that the discharge end 13 of the hollow tubular body 11 may be snugly attached to the open end 21 of the container 20 in a variety of different ways. FIGS. 8 and 10 further illustrate other exemplary hollow tubular bodies 11 in which the discharge end 13 is adapted to snugly fit onto an open end 21 of a container 20.

Figure 2:
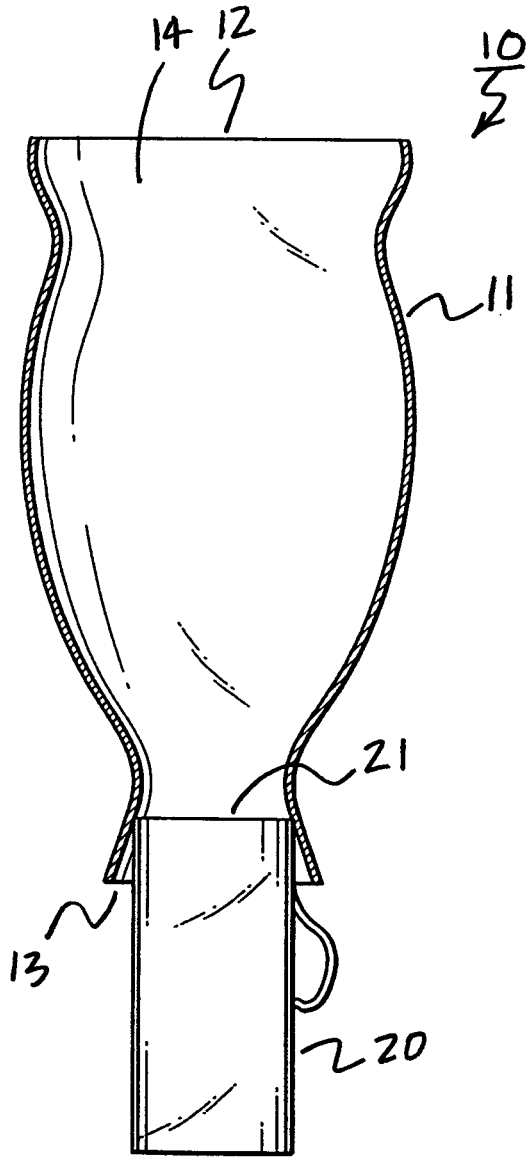

FIG. 2 depicts another exemplary configuration for the discharge end 13 of the hollow tubular body 11. In this illustration, the discharge end 13 of the hollow tubular body 11 is snugly attached over the open end 21 rim portion of the container 20. As the container 20 is filled with a liquid 15, foam 16 is generated and rises back into the discharge end 13 of the hollow tubular body 11. The foam 16 is captivated therein so that when the hollow tubular body 11 is removed from the container 20, the foam 16 may also be easily removed from the container 20.

A predetermined amount of foam 16 is allowed to remain on the surface of the liquid 15 in the container 20. The predetermined amount of foam 16 remaining depends on a variety of different factors and on various parameters and properties of the container 20 selected and the contour of the hollow tubular body 11 of the foam retainer 10.

Figure 3:
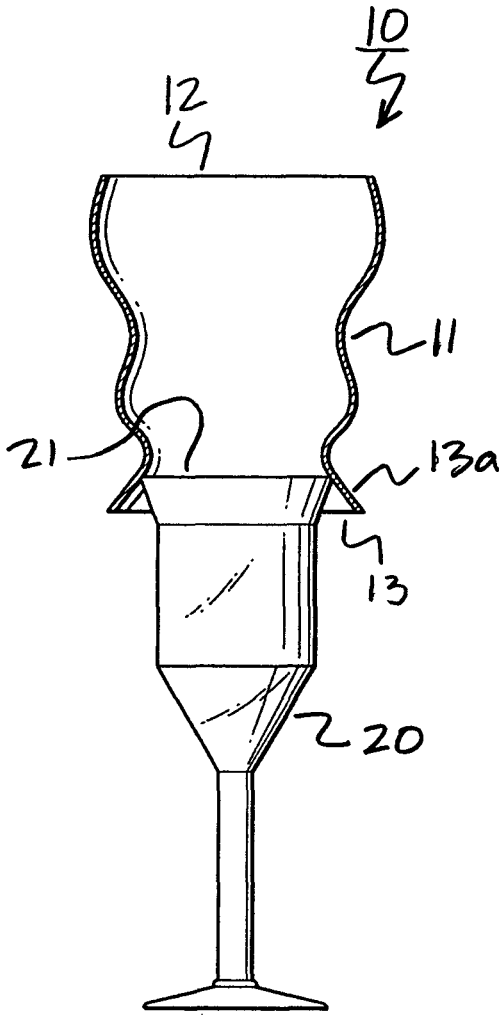
Figure 4:
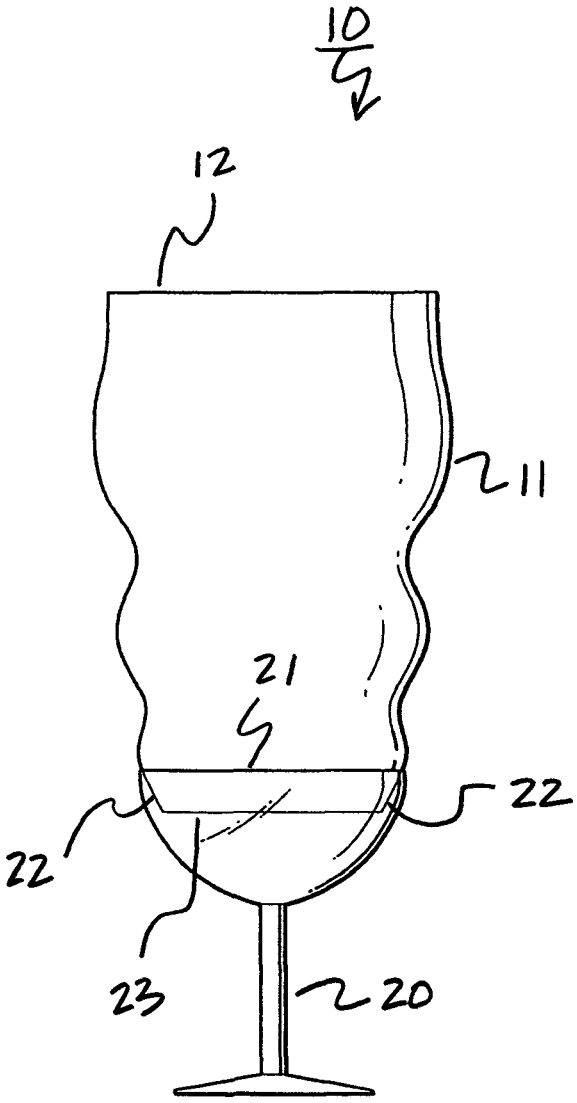
FIGS. 4 and 17-20 illustrate an exemplary foam retainer having a receiving end adapted to be placed within a container in accordance with this invention.
Figure 5:
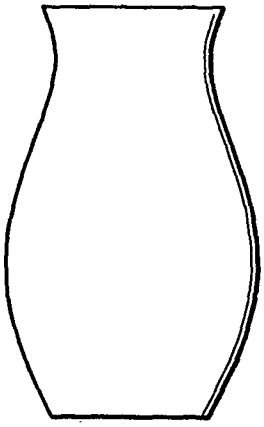
FIGS. 5-16 illustrate various foam retainers employing various configurations of varying cross sectional diameter in accordance with this invention.
Figure 6:
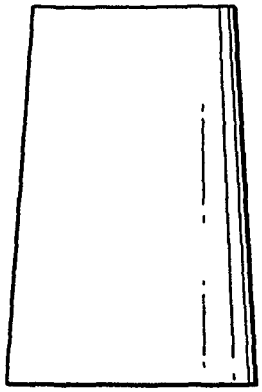
Figure 7:
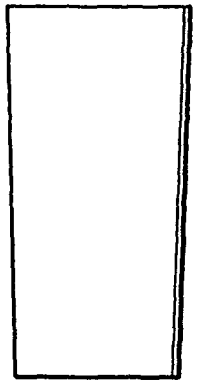

FIGS. 3 and 4 help to illustrate this concept. FIG. 3 shows a hollow tubular body 11 including a large lower flair portion 13*a* at the discharge end 13. Thus, when the hollow tubular body 11 is removed from the container 20, more foam 15 is likely to remain on the beverage because the capillary forces of the bubbles in the foam are strained and overcome by the force of gravity. However, if the container 20 selected has a smaller opening 21, such as that shown in FIG. 4, then together the capillary forces would be sufficiently strong enough to substantially overcome the force of gravity at the discharge end 13 of the hollow tubular body 11 since the cross section area of the discharge end 23 of the hollow tubular body 11 is small.

In more detail, FIG. 4 depicts a hollow tubular body 11 having a smaller discharge end 13 cross sectional area. The smaller discharge end 13 allows the hollow tubular body 11 to captivate and hold more of the foam 15 within the hollow tubular body 11. In a beverage where less foam is desires, such as in a wine or Champaign, this configuration for the hollow tubular body 11 would be preferred. Likewise, the contour of the hollow tubular body 11 can also regulate the amount of foam 16 intended to remain on top of the beverage.

In accordance with one exemplary configuration shown in FIG. 4, the concentric space 22 defined between the opening 21 of the container 20 and the outer surface of the discharge end 13 of the hollow tubular body 11 provides an area into which a predetermined amount of foam 16 may reside. When the hollow tubular body 11 is removed from the container 20, the predetermined amount of foam 16 lodged within the concentric space 22 is allowed to remain in the container 20 and to come to rest on top of the liquid 15. As a result, the amount of foam 16 remaining in the container 20 may be predetermined.

FIGS. 5-13 illustrate various other exemplary configurations in which the hollow tubular body 11 can be constructed. As shown, the hollow tubular body 11 is made up from a variety of differing shapes in which the diameter of the hollow tubular body 11 varies throughout the length of the hollow tubular body 11. It is to be understood that the measurements may vary in dimension, shape and angle. The shape may very depending on various shapes of commercially available containers, such as a glass, a cup, a mug, a goblet, a flute, and any other type of container or the like. The basic shape may be that of a trapezoid or cone having a wider opening at one end, such as the receiving end 12, and a narrower opening at another end, such as the discharge opening 13. The various constructions shown herein allow for a liquid to be neatly poured into the various designated containers 20 at a rapid pace in succession. Although various configurations are described, it is to be understood that the hollow tubular body 11 may take a variety of different shapes, including but not limited to the sides of the hollow tubular body 11 having obtuse, symmetrical, asymmetrical, or acute angles. Likewise, the length and width may be varied, and/or the hollow tubular body 11 may be curved or straight.

FIGS. 5-7, 9 and 11-13 show a combination use hollow tubular body 11 in which at least a first end of the discharge end 13 or the receiving end 12 of the hollow tubular body 11 snugly fits within the open end 21 of the container 20. Likewise, another end of the discharge end 13 or the receiving end 12 of the hollow tubular body 11 snugly fits over the open end 21 of the container 20. As such, the hollow tubular body 11 is versatile and can be used in a variety of different ways.

FIGS. 12, 17, 19-27 and 29-30 illustrate another aspect of the invention in which the hollow tubular body 11 may include measurement indicia 30. The indicia 30 may be constructed as part of the contour of the hollow tubular body 11 and/or the indicia 30 may be imprinted onto the hollow tubular body 11. It is to be understood that the indicia may be printed and/or constructed as part of the hollow tubular body 11 in a variety of suitable methods, now known or later discover in accordance with this invention. The indicia 30 may provide a variety of different types of information, such as measurement indicators (e.g., liters, ounces, inches, and the like), graphics, and/or and for any other useful and/or aesthetic purpose.

Figure 21:
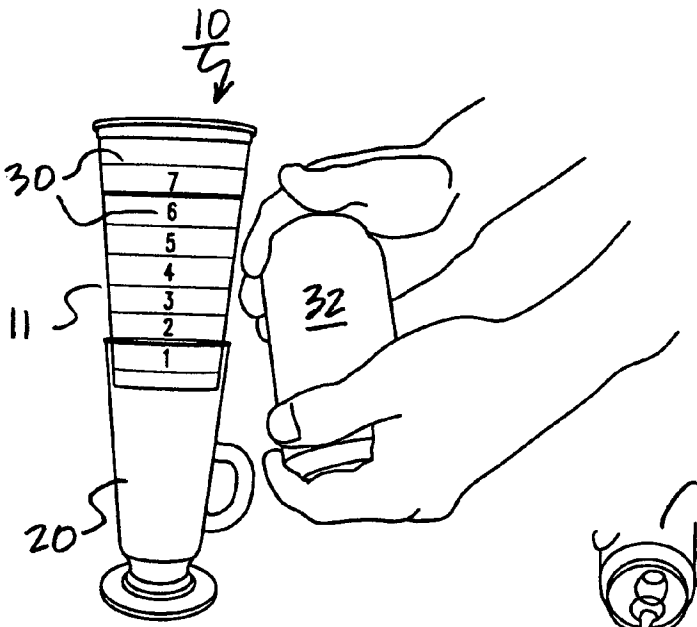
FIGS. 21-28 illustrate the operation of the foam retainer having a discharge end adapted to be placed inside of, and within, an opening of an upper end of the rim of the container being filled with a liquid in accordance with this invention.
Figure 22:
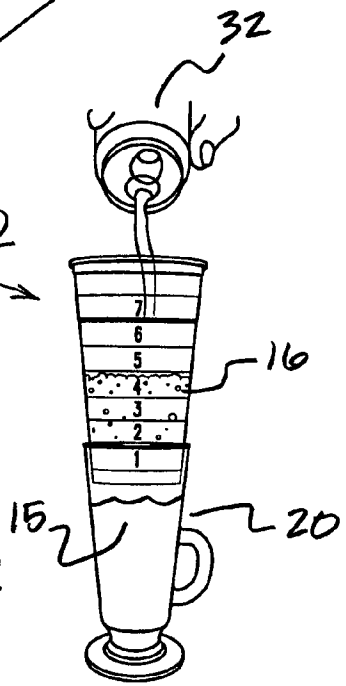

Referring to FIGS. 21-24, the indicia 30 shown here is provided for measurement purposes. FIG. 21 illustrates the use of the hollow tubular body 11 in operation. A carbonated beverage container 32 containing dissolved carbon-dioxide gas, such as a beer, soda, or the like, may be desired for consumption. Since the pressure inside the beverage container 32 is greater than the pressure outside the beverage container 32, when the beverage container 32 container is opened and poured, the pressurized seal is broken and the carbon-dioxide gas raises to the top of the beverage container 32 generating a frothy head of foam 16 in combination with a mixture of the liquid 15 and the carbon dioxide gas released as the beverage is poured into the container 20, as shown in FIG. 22.

Figure 23:
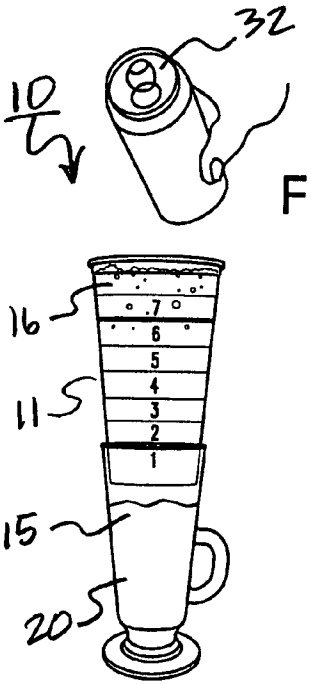
Figure 24:
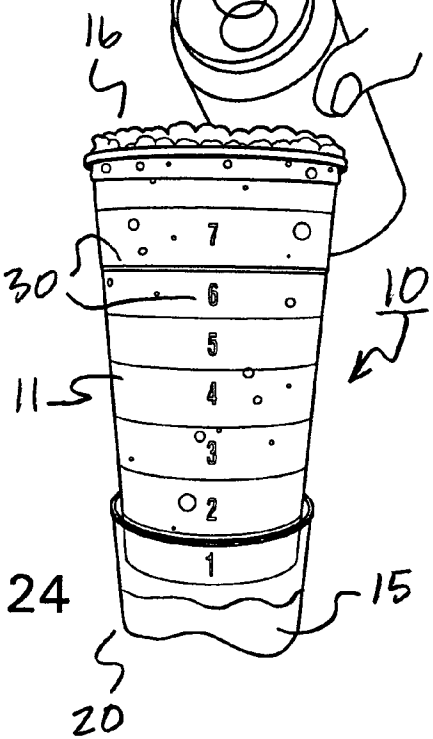

FIGS. 22-24 show that as the liquid 15 of beverage container 32 is poured out into the container 20, the foam 16 continues to rise up into the hollow tubular body 11. As desired, the server may quickly remove the hollow tubular body 11 from the container 20 and serve the beverage 15 immediately.

Figure 31:
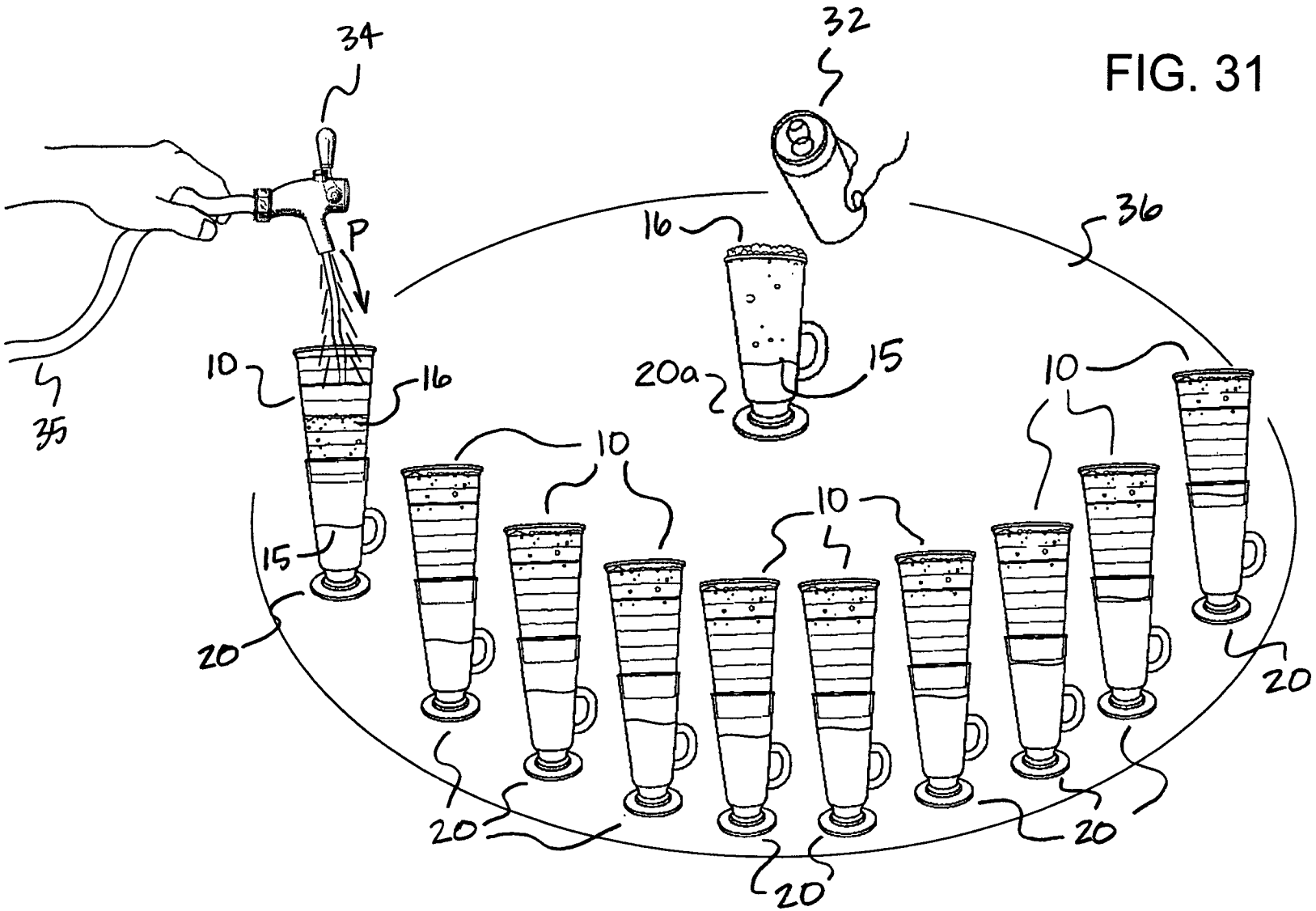
FIG. 31 is an exemplary illustration of a comparison of a server pouring a single drink in a conventional manner, versus the server utilizing numerous foam retainers for pouring various drinks in the same amount of time it would take to pour the single drink in the conventional manner in accordance with this invention.

FIG. 31 is an exemplary illustration of a comparison of a server preparing a single drink 20*a* in a conventional manner, versus the server utilizing numerous foam retainers 10 and pouring beverage drinks in various containers 20 in the same amount of time it would take to pour the single drink 20*a* in the conventional manner in accordance with this invention. In more detail, a single carbonated drink 32 is shown poured into a container 20*a* in the center of a table 36 in a conventional manner. Traditionally, the server would pour a portion of the drink into the container 20*a* and would have to wait for the foam 16 built up in the container 20 to dissipate before the server could add more of the carbonated beverage 32. This process is extremely time consuming and inefficient for a busy establishment with many patrons in the restaurant. The server is severely hampered not by the number of beverages he can manually pour but instead by the dissipation of the foam 16 built up in the container 20*a*.

FIG. 31 illustrates the advantage of this invention by way of visual comparison. That is, in the time that it would take to pour the single carbonated beverage 32 into the container 20*a* shown in the middle of the table 36, employing the use of the foam retainers 10, at least ten other containers 20 can be prepared by the server and made ready for delivery to various customer tables. By employing the various foam retainers 10, as each container 20 is consecutively filled, the residual foam 16 is allowed to expand and build up into the hollow tubular body 11 of the foam retainer 10. As the other containers 20 are filled, the foam 16 in the previous container 20 is allowed dissolve as each successive container 20 is filled. This process is substantially more efficient for the server and to the profit realized by the restaurant since the restaurant will be able to serve more drinks and therefore sell more drinks. Accordingly, the server is substantially more efficient because he is no longer hampered by the number of beverages he can manually fill the entire container 20 since he no longer has to wait for the foam 16 to dissipate.

Conventionally, a tap 34 sued to dispense a carbonated beverage is under a predetermined pressure which is provided to serve the maximum amount of the carbonated beverage with as little a head foam as possible. Bartenders and servers have further adopted techniques for attempting to sere the carbonated beverage 32 while reducing the foam 16. One such technique is to place the dispensing spout of the tap 34 close to the edge of an inner wall of the drinking container to further reduce the splashing of the liquid 15 from the tap 34 to the bottom of the container 20*a* which contributes to the build up of foam 16 in the container 20*a*. None of these techniques, however, have substantially sped up the process for dispensing the carbonated beverage 15 and/or to reduce the foam 16.

FIG. 31 illustrates yet another advantage of this invention is that the pressure (P) in the tap 34 used to dispense the carbonated beverage 15 may be substantially increased. By using an extendable hose 35 fluidly connected to tap 34 and by increasing the pressure (P) within the tap 34, the server can prepare more drinks and consequently serve the drinks faster since the greater foam generated will be captured in the hollow tubular body 11 of the foam retainer 10 as the carbonated beverage 15 in the containers 20 is filled.

Figure 28:
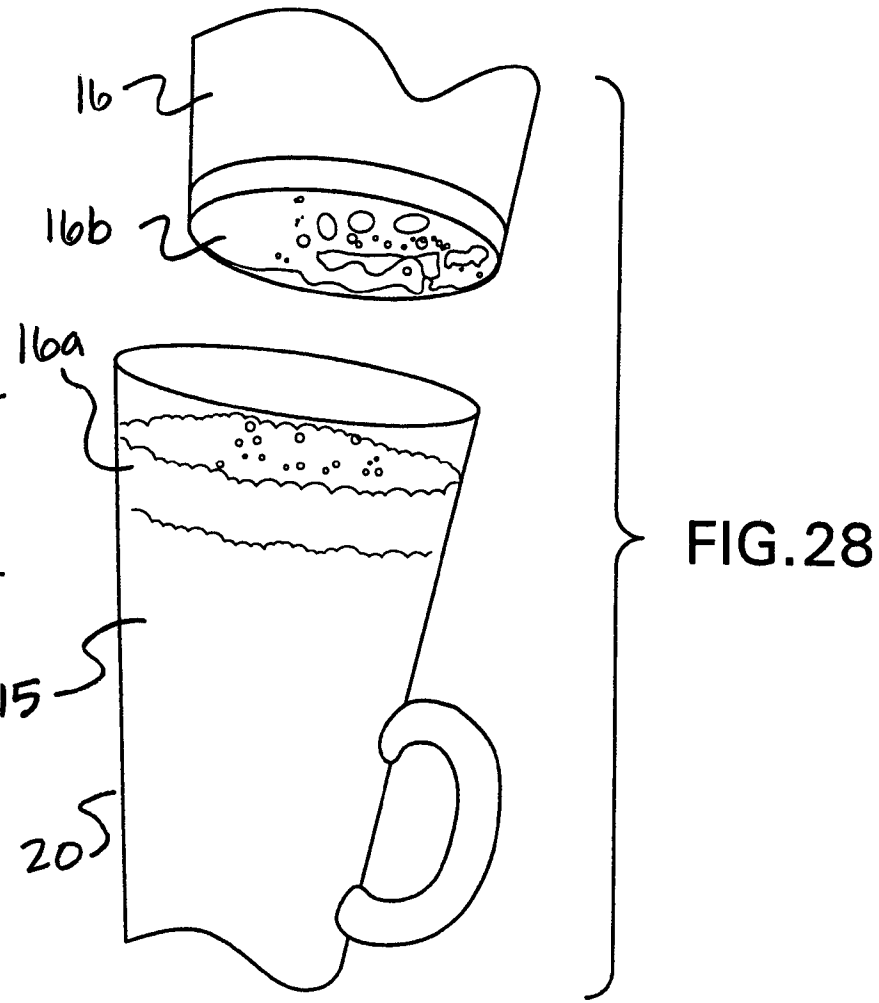

As shown in FIG. 28, when the hollow tubular body 11 is removed from the container 20, a desired quantity of the remaining foam 16*a* may stay in the container 20 and the remainder of the removed foam 16*b* is captured by, and detached from the quantity of the remaining foam 16*a* when the hollow tubular body 11 is removed from the container 20.

The quantity of the remaining foam 16*a* may be a predetermined amount based on a variety of different dimensions and characteristics, including but not limited to, the container 20, the opening 21 of the container 20, the material composition of the container 20, the diameter of the discharge end 13 of the hollow tubular body 11, the composition of the hollow tubular body 11, and the fluid viscous properties of the liquid 15 and the foam 16.

Figure 26:
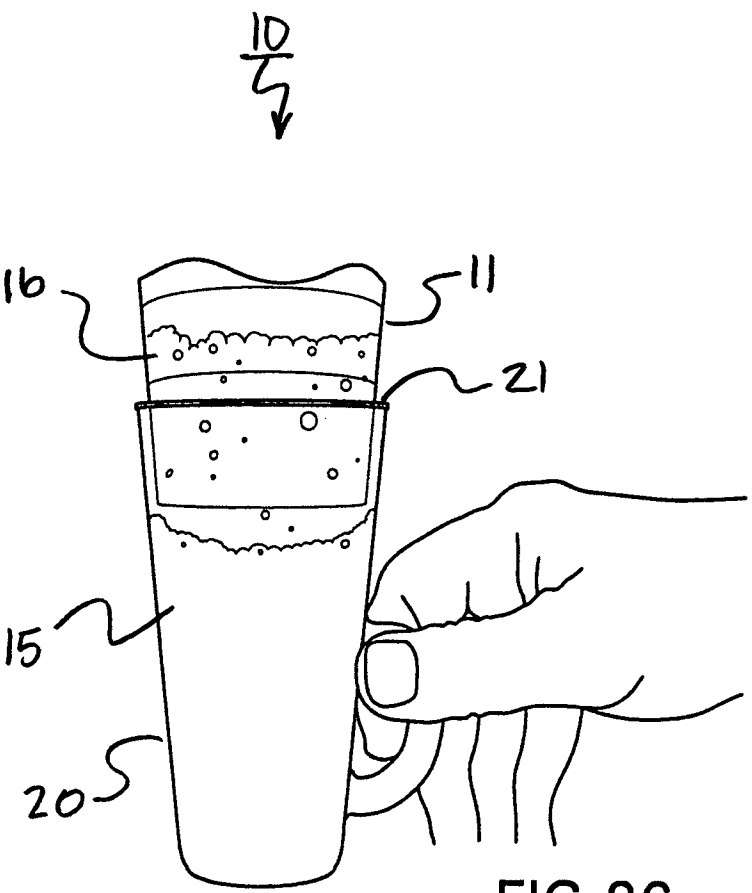
Figure 25:
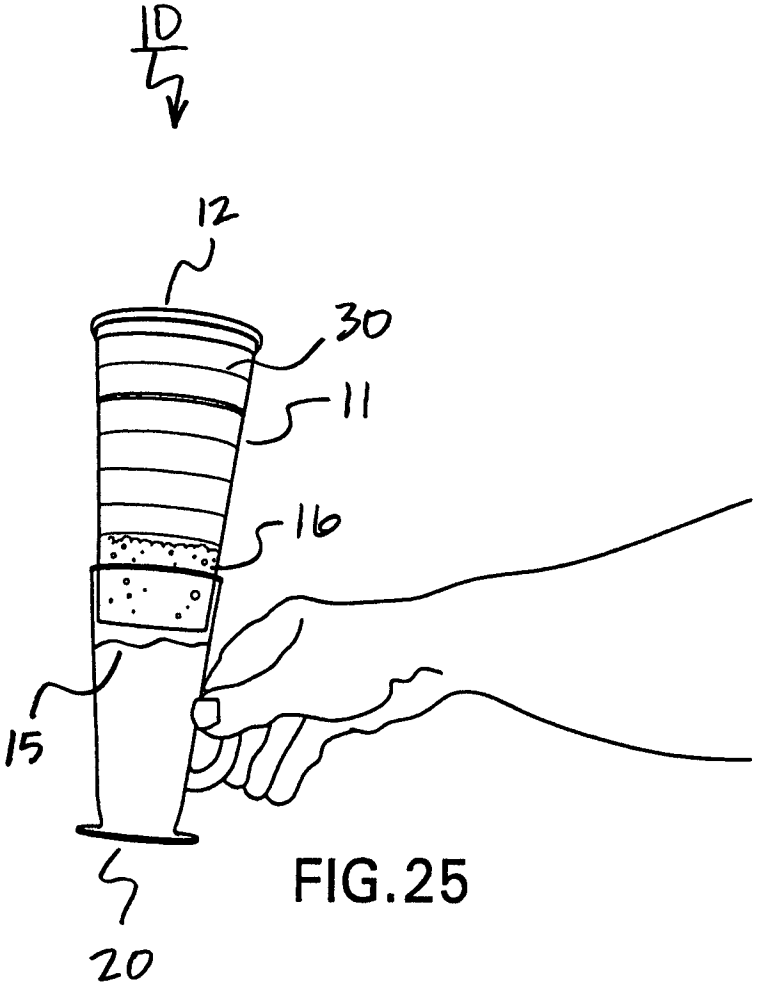
Figure 27:
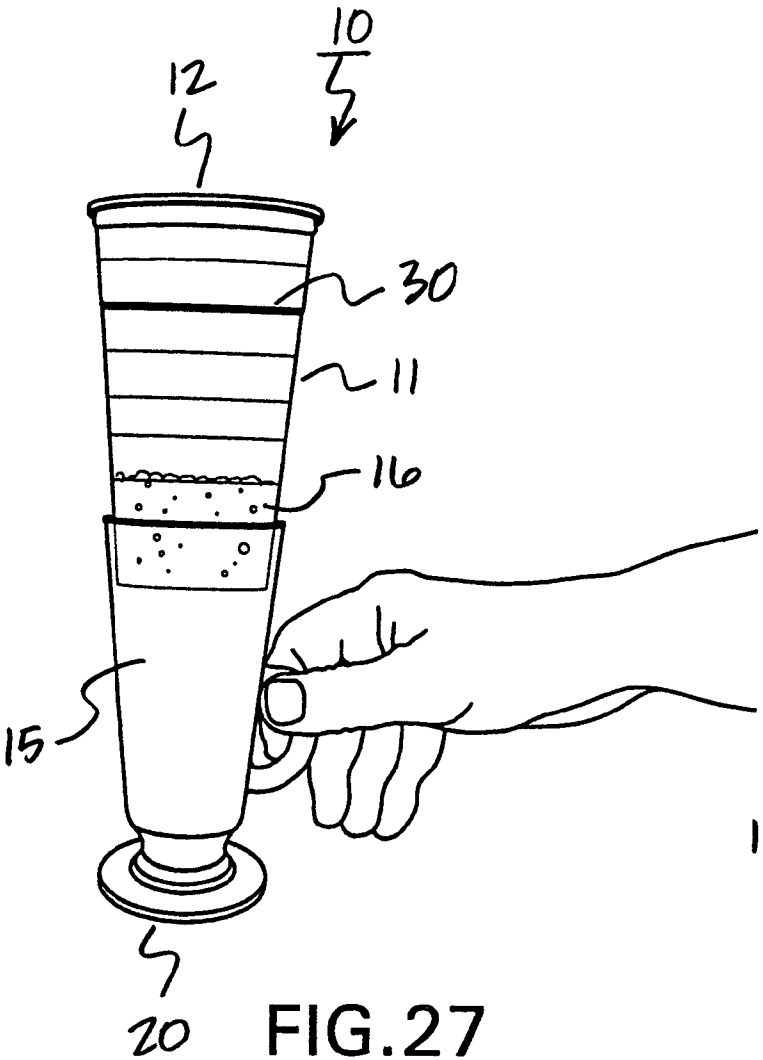

As shown in FIGS. 25-27, the preparer may use the hollow tubular body 11 as a measurement gauge in which the hollow tubular body 11 and indicia 30 are provided as an easy visual guide to allow the preparer to determine when to stop pouring so that the foam 16 does not spill over the receiving end 12 of the hollow tubular body 11 causing a spill. As shown in FIG. 27, the hollow tubular body 11 may be kept on top of the container 20 until just before the beverage is to be served to the consumer. Using the hollow tubular body 11 in transport provides a unique advantage, in that, when the server delivers the beverage from the bar to the customer's table, the hollow tubular body 11 provides protection from spillage over the container 20 as well as to allow the foam 16 to dissolve while in transit thereby producing more of the liquid beverage 15 in the container 20 when it is ultimately served to the customer.

As mentioned before and as shown in FIG. 28, when the server has arrived at the consumer's table, the server may then remove the hollow tubular body 11 from the container 20. By removing the hollow tubular body 11 from the container 20, any excess foam 16*b* is separated and removed from a predetermined amount of residual remaining foam 16*a*. The remaining foam 16*a* is then served with the beverage 15 in the container 20 to the customer. By employing this method and the use of the foam retainer 10, the bartender and the server of the beverage 15 are more efficient and likewise more responsive to the consumer and the delivery of their beverage 15.

Figure 30:
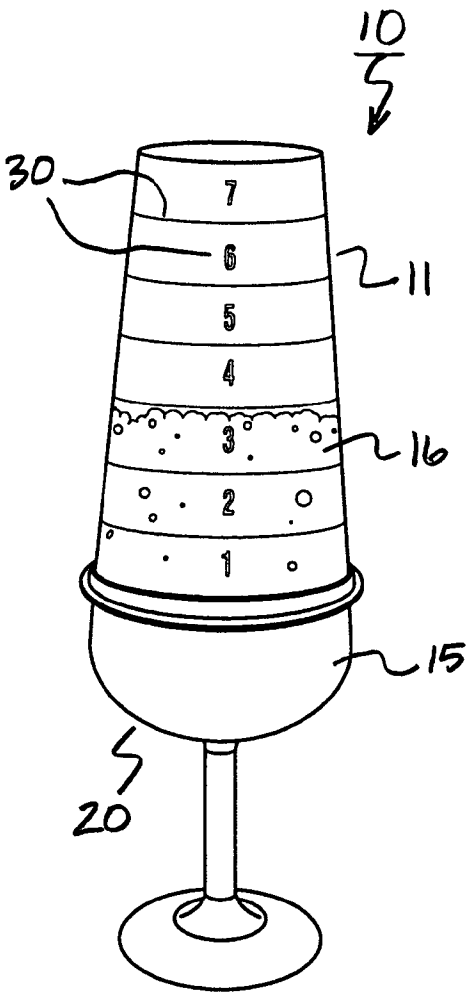
FIGS. 29-30 illustrate the operation of the foam retainer having a discharge end adapted to be placed outside of, and over, an opening of the container in accordance with this invention.
Figure 29:
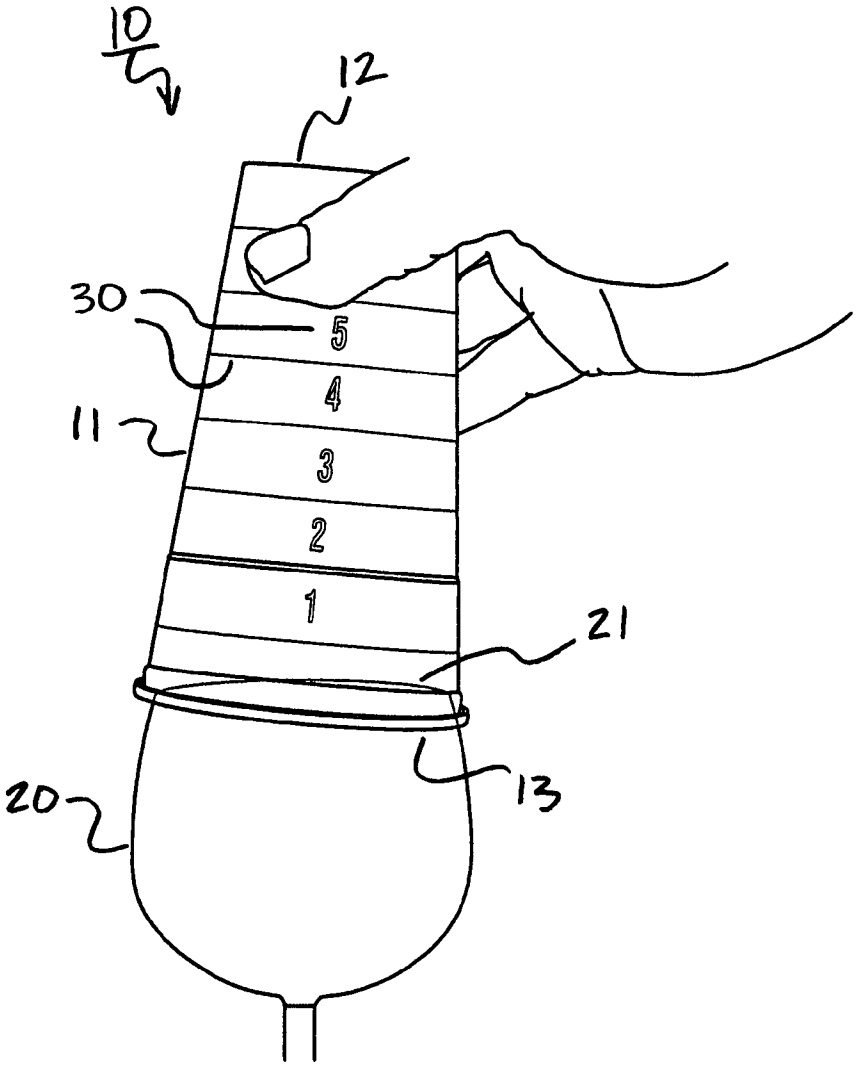

FIGS. 29-30 illustrate the use of a hollow tubular body 11 adapted to be snugly attached over the open end 21 of another container 20. As the container 20 is filled with a liquid 15, foam 16 is generated and rises back into the discharge end 13 of the hollow tubular body 11. The foam 16 is captivated within the hollow tubular body 11 such that when the hollow tubular body 11 is removed from the container 20, the foam 16 may also be easily removed from the container 20, as similarly shown in FIG. 28.

Likewise, the preparer may keep the hollow tubular body 11, as shown in FIG. 30 in the container 20 until just before the beverage is to be served at the consumer's table. Leaving the hollow tubular body 11 attached to the container 20 allows the foam 16 to further dissipate thereby producing more of the liquid 15 into the container 20 prior to serving the beverage to the consumer.

The hollow tubular body 11 may be constructed of various sizes and adapted to receive various quantities of beverage from various beverage containers 32. As shown in FIG. 24, the hollow tubular body 11 labeled up to "7" in this exemplary embodiment is adapted to receive the entire contents of the beverage container 32 without spilling over. Accordingly, the various indicia 30 are provided to associate a predetermined height of the foam 16 in the hollow tubular body 11 with a predetermined liquid 15 level in the container 20. As mentioned earlier, any type of indicia 30 may be provided on the hollow tubular body 11.

A method for providing various steps for captivating and removing the foam head of a beverage from a container served in accordance with this invention is described herein. The method provides for positioning and sealing a discharge end 13 of a hollow tubular body 11 over an open end 21 of a container 20. Then, dispensing a liquid 15 into a receiving end 12 of the hollow tubular body 11, and allowing a predetermined head of foam 16 to build up in the container 20 and back up into the hollow tubular body 11. The predetermined foam 16 head is then captivated within the hollow tubular body. The hollow tubular body 11 is then removed and the predetermined foam head is also removed from the container 20 as the hollow tubular body 11 is removed from the container 20. The hollow tubular body 11 may be selectively removed when the predetermined foam 16 head reaches a predetermined level in the hollow tubular body 11. The predetermined level may be designated by indicia 30 and/or indicators constructed into the contour of the hollow tubular body 11 which would indicate the level of the foam 16.

The discharge end 13 of the hollow tubular body 11 may positioned and sealed within an inside rim of the open end 21 of the container 20. Likewise, the discharge end of 21 the hollow tubular body 11 may be positioned and sealed over an outside rim of the open end 21 of the container 20. It is to be understood that one, or both ends, i.e., the receiving end 12 or the discharge end 13 may be adapted to be positioned within an inside rim of the open end 21 of the container 20. Similarly, both ends, i.e., the receiving end 12 or the discharge end 13 may be adapted to be positioned over an outer rim of the open end 21 of the container 20.

It is to be understood that the hollow tubular body 11 may be made from a variety of materials, such as for example: a polymer, metal, wood, paper, and/or any other suitable composition capable of transferring the liquid into a container and for capturing and retaining the foam head of a beverage in accordance with this invention.

It will be recognized by those skilled in the art that changes or modifications may be made to the above described embodiments without departing from the broad inventive concepts of the invention. It is understood therefore that the invention is not limited to the particular embodiments which are described, but is intended to cover all modifications and changes within the scope and spirit of the invention.

What is claimed is:

1. A method of removing foam from a container comprising:

positioning and sealing a discharge end of a hollow tubular body against an open end of the container;

dispensing a liquid into a receiving end of the hollow tubular body and allowing it to drain into the container:

allowing a predetermined foam head to build up in the container and back up into the hollow tubular body;

captivating the predetermined foam head within the hollow tubular body; and removing the predetermined foam head from the container by removing the hollow tubular body from the container when the predetermined foam head reaches a certain level in the hollow tubular body and emptying the foam from the hollow tubular body.

2. The method as recited in claim 1, wherein the positioning and sealing step further comprises:

positioning the discharge end of the hollow tubular body against an open end of the container, is within an inside rim of the open end of the container.

3. The method as recited in claim 1, wherein the positioning and sealing step further comprises:

positioning the discharge end of the hollow tubular body against an open end of the container, is over an outside rim of the open end of the container.

4. The method as recited in claim 1, wherein the positioning and sealing step further comprises:

positioning at least one end of the discharge end and the receiving end of the hollow tubular body against an open end of the container, is within an inside rim of the open end of the container.

5. The method as recited in claim 1, wherein the positioning and sealing step further comprises:

positioning at least one end of the discharge end and the receiving end of the hollow tubular body against an open end of the container, is over an outer rim of the open end of the container.

6. A method of removing foam from a container comprising:

positioning a discharge end of a hollow tubular body against an open end of the container;

dispensing a liquid through a receiving end of the hollow tubular body and allowing a foam head to back up into the hollow tubular body; and removing the foam head by removing the hollow tubular body from the container and allowing the foam from the hollow tubular body to empty.

7. The method as recited in claim 6, wherein the discharge end of the hollow tubular body against an open end of the container, is snugly positioned within the open end of the container.

8. The method as recited in claim 7, wherein when the foam head has backed up to a predetermined level, the hollow tubular body is then removed from the container.

9. The method as recited in claim 6, wherein the discharge end of the hollow tubular body against an open end of the container, is snugly positioned over the open end of the container.

10. The method as recited in claim 6, wherein at least one end of the discharge end and the receiving end of the hollow tubular body against an open end of the container, is snugly fitted within the open end of the container, and wherein at least another end of the discharge and the receiving end of the hollow tubular body is snugly fitted over the open end of the container.

11. The method as recited in claim 6, wherein the hollow tubular body comprises various cross sectional shapes of varying diameter.

12. The method as recited in claim 6, wherein the hollow tubular body includes measurement indicia adapted to associate a predetermined height of the foam in the hollow tubular body with a predetermined fluid level in the container.

13. A method of removing foam from a container comprising:

positioning and sealing a discharge end of a hollow tubular body against an open end of the container;

dispensing a liquid into a receiving end of the hollow tubular body and allowing it to drain over a wall of the hollow tubular body into the container:

allowing a predetermined foam head to build up in the container and back up into the hollow tubular body and over the wall therein;

captivating the predetermined foam head within the hollow tubular body; and removing the predetermined foam head from the container by removing the hollow tubular body from the container when the predetermined foam head reaches a certain level in the hollow tubular body and allowing the foam to drain therein.

14. The method as recited in claim 13, wherein the discharge end of the hollow tubular body is snugly positioned within an inside rim of the open end of the container.

15. The method as recited in claim 13, wherein the discharge end of the hollow tubular body is snugly positioned over a rim of the open end of the container.

* * * * *